US009555649B2

(12) United States Patent
Mizutani

(10) Patent No.: US 9,555,649 B2
(45) Date of Patent: Jan. 31, 2017

(54) IMAGE RECORDING APPARATUS AND IMAGE RECORDING METHOD

(71) Applicant: SEIKO EPSON CORPORATION, Tokyo (JP)

(72) Inventor: Seigo Mizutani, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/643,384

(22) Filed: Mar. 10, 2015

(65) Prior Publication Data

US 2015/0266325 A1 Sep. 24, 2015

(30) Foreign Application Priority Data

Mar. 18, 2014 (JP) ..... 2014-054353

(51) Int. Cl.
*B41J 11/02* (2006.01)
*B41J 29/38* (2006.01)

(52) U.S. Cl.
CPC ..... *B41J 11/02* (2013.01); *B41J 29/38* (2013.01)

(58) Field of Classification Search
CPC ..... B41J 2/04563; B41J 2/0458; B41J 11/003; B41J 25/308; B41J 25/312; B41J 2/14153; B41J 2/045501; B41J 11/02; B41J 29/38; G01N 21/00
USPC ..... 347/17
See application file for complete search history.

(56) References Cited

U.S. PATENT DOCUMENTS 4,705,016 A * 11/1987 Sekiya ..... 125/13.01
4,978,115 A * 12/1990 Sato et al. ..... 271/124
5,570,959 A * 11/1996 Moriwaki ..... B41J 25/308 400/56
5,872,579 A * 2/1999 Handa ..... B41J 25/308 347/8
6,312,319 B1 * 11/2001 Donohue et al. ..... 451/56
2007/0285462 A1 * 12/2007 Iwakura ..... B41J 25/308 347/37
2009/0322810 A1 * 12/2009 Usuda ..... B41J 2/04556 347/8
2010/0039473 A1 * 2/2010 Terada ..... B41J 11/0095 347/19
2012/0050373 A1 3/2012 Korogi et al.
2012/0262763 A1 * 10/2012 Tang et al. ..... 358/448
2013/0265362 A1 10/2013 Toya
2013/0278665 A1 10/2013 Imamura
2015/0266325 A1 * 9/2015 Mizutani ..... B41J 29/393 347/17

FOREIGN PATENT DOCUMENTS

JP 2006-088612 A 4/2006
JP 2010-076872 A 4/2010
JP 2010-111474 A 5/2010
JP 2012-051178 A 3/2012
JP 2013-119167 A 6/2013
JP 2013-215983 A 10/2013
JP 2013-220645 A 10/2013

* cited by examiner

*Primary Examiner* — Julian Huffman
*Assistant Examiner* — Sharon A Polk
(74) *Attorney, Agent, or Firm* — Global IP Counselors, LLP

(57) ABSTRACT

An image recording apparatus includes: a sensor capable of detecting a state of an object; a drive unit capable of moving the sensor; and a control unit configured to control the drive unit.

9 Claims, 4 Drawing Sheets

IMAGE RECORDING APPARATUS AND IMAGE RECORDING METHOD

BACKGROUND

1. Technical Field

The present invention relates to an image recording apparatus and an image recording method for recording an image on a recording medium, and particularly to a technique of detecting states of a recording medium and a support member for supporting the recording medium.

2. Related Art

In the related art, a printer which records an image on a recording medium by causing a head facing the recording medium to eject ink while transporting the recording medium is known. According to such a printer, a sensor capable of detecting a state in the apparatus is generally used for controlling execution of image recording in accordance with the state in the apparatus. For example, a printer disclosed in JP-A-2013-215983 is provided with a sensor which detects paper jam or foreign matters such as dust that is present on the recording medium.

Incidentally, there is a case where a relative positional relationship between an object and a sensor varies in an image recording apparatus (printer) as described above. For example, a relative positional relationship between a recording medium as the object and a sensor varies if a thickness of the recording medium varies according to the printer disclosed in JP-A-2013-215983. In such a case, there is a concern in that detection accuracy of the sensor deteriorates.

SUMMARY

An advantage of some aspects of the invention is to provide a technique of handling deterioration of the detection accuracy of the sensor caused by variations in the relative positional relationship between the sensor and the object.

According to an aspect of the invention, there is provided an image recording apparatus including: a sensor capable of detecting a state of an object; a drive unit capable of moving the sensor; and a control unit configured to control the drive unit.

According to another aspect of the invention, there is provided an image recording method including: adjusting a relative positional relationship between a sensor and an object by a drive unit capable of moving the sensor which is able to detect a state of the object; and detecting a state of the object by the sensor.

According to the invention (image recording apparatus, image recording method) configured as described above, the sensor can be moved by the drive unit. For this reason, it is possible to adjust a relative positional relationship between the sensor and the object. As a result it is possible to handle deterioration of a detection accuracy of the sensor caused by variations in the relative positional relationship between the sensor and the object.

In this case, the object may be able to support a recording medium, on which an image is recorded, and may be a support member which thermally expands with an increase in temperature. With such a configuration, there is a concern in that accuracy of detecting a state of the support member by the sensor deteriorates due to variations in the relative positional relationship between the sensor and the support member if the support member thermally expands with an increase in temperature. However, since the sensor can be moved by the drive unit in the invention, it is possible to adjust the relative positional relationship between the sensor and the support member. As a result, it is possible to handle the deterioration of the detection accuracy of the sensor caused by the variations in the relative positional relationship between the sensor and the support member.

In this case, the image recording apparatus may further include an acquisition unit configured to acquire information relating to the thermal expansion of the support member, and the control unit may control the drive unit in accordance with the information acquired by the acquisition unit and adjust a relative positional relationship between the sensor and the support member. With such a configuration, it is possible to adjust the relative positional relationship between the sensor and the support member in accordance with the thermal expansion of the support member. As a result, it is possible to suppress deterioration of the detection accuracy of the sensor caused by variations in the relative positional relationship between the sensor and the support member.

In this case, the acquisition unit may acquire, as the information, at least one of a temperature of the support member, a temperature of the recording medium, and displacement of the support member caused by the thermal expansion.

In this case, the object may be a recording medium on which an image is recorded. That is, with such a configuration, there is a concern in that accuracy of detecting a state of the recording medium by the sensor deteriorates due to variations in the relative positional relationship between the sensor and the recording medium if the thickness of the recording medium varies with replacement or the like of the recording medium. Thus, since the center can be moved by the drive unit in the invention, it is possible to adjust the relative positional relationship between the sensor and the recording medium. As a result, it is possible to handle the deterioration of the detection accuracy of the sensor caused by the variations in the relative positional relationship between the sensor and the recording medium.

In this case, the image recording apparatus may further include an acquisition unit configured to acquire information relating to a thickness of the recording medium, and the control unit may control the drive unit in accordance with the information acquired by the acquisition unit and adjust a relative positional relationship between the sensor and the recording medium. With such a configuration, it is possible to adjust the relative positional relationship between the sensor and the recording medium in accordance with the thickness of the recording medium. As a result, it is possible to suppress deterioration of the detection accuracy of the sensor caused by variations in the relative positional relationship between the sensor and the recording medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
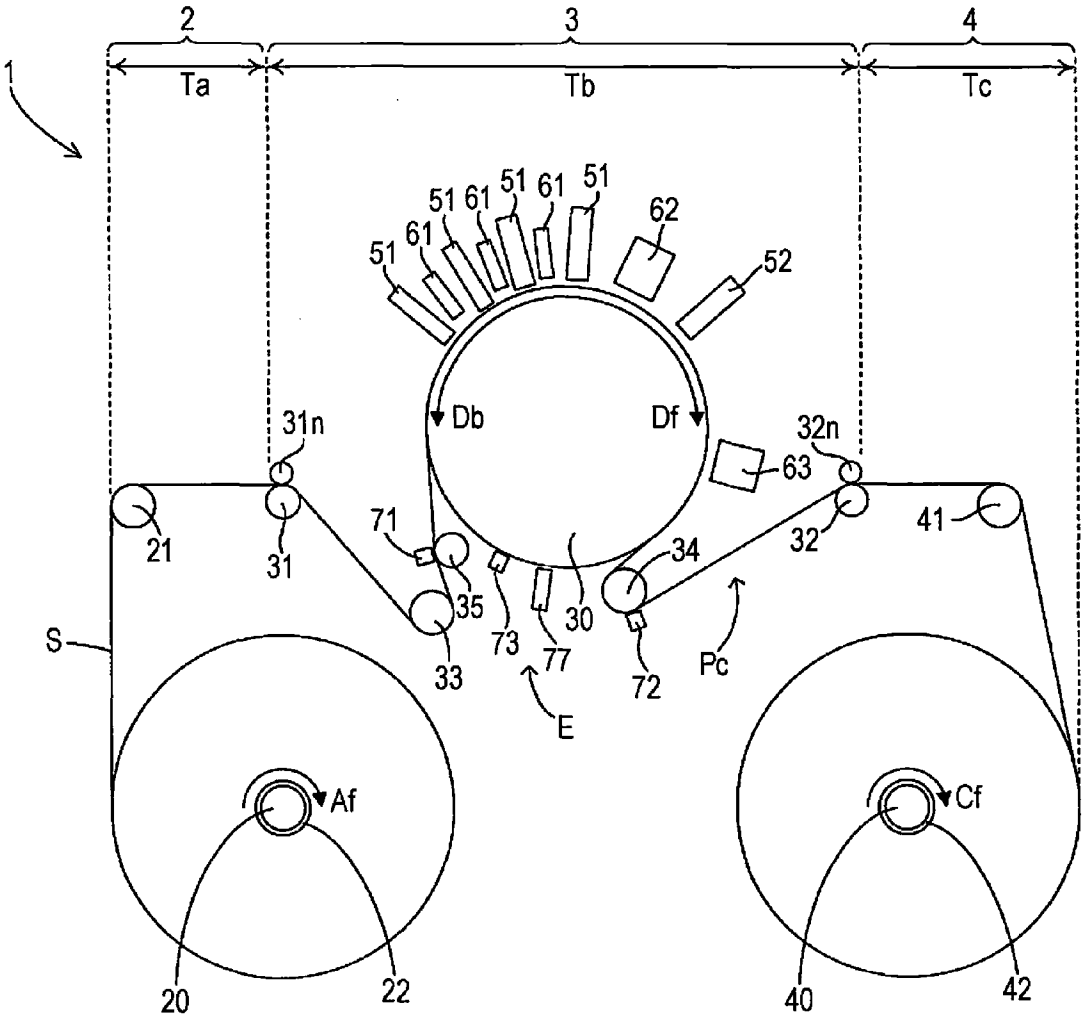
FIG. 1 is a front view showing an apparatus configuration of a printer which can implement the invention.

FIG. 1 is a front view schematically showing an example of an apparatus configuration included in a printer which can implement the invention. According to a printer 1, a sheet S (web), both end of which are wound around a delivery shaft 20 and a winding shaft 40 in roll shapes, is stretched along a transport path Pc, and the sheet S is subjected to image recording while being transported in a transport direction Df from the delivery shaft 20 toward the winding shaft 40 as shown in FIG. 1. Types of a base material of the sheet S are roughly classified into a paper type base material and a film type base material. Specific examples of the paper type base material include a high-quality paper, a cast-coated paper, an art paper, and a coated paper. Specific examples of the film-type base material include a polyethylene terephthalate (PET) film and a polypropylene (PP) film. Roughly, the printer 1 is provided with a delivery unit 2 (delivery region) configured to deliver the sheet S from the delivery shaft 20, a process unit 3 (process region) configured to record an image on the sheet S which is delivered by the delivery unit 2, and a winding unit 4 (winding region) configured to wind the sheet S, on which the image has been recorded by the process unit 3, around the winding shaft 40. In the following description, a surface, on which the image is recorded, in both surfaces of the sheet S will be referred to as a front surface, and another surface opposite to the surface will be referred to as a back surface.

The delivery unit 2 is provided with the delivery shaft 20 around which an end of the sheet S is wound and a driven roller 21 around which the sheet S drawn out of the delivery shaft 20 is wound. The end of the sheet S is wound around and supported by the delivery shaft 20 in a state in which the front surface of the sheet S faces outside. By rotating the delivery shaft 20 in a rotation direction Af (a clockwise direction in FIG. 1), the sheet S wound around the delivery shaft 20 is delivered to the process unit 3 via the driven roller 21. In addition, the sheet S is wound around the delivery shaft 20 via a core tube 22 which can be attached to and detached from the delivery shaft 20. Therefore, if the sheet S wound around the delivery shaft 20 is used up, the sheet S wound around the delivery shaft 20 can be replaced by attaching a new core tube 22 around which the sheet S is wound in a roll shape to the delivery shaft 20.

The process unit 3 supports the sheet S, which is delivered by the delivery unit 2, at a rotation drum 30 and to appropriately causes the respective functional units 51, 52, 61, 62, and 63 arranged along an outer circumferential surface of the rotation drum 30 to perform processing to record an image on the sheet S. In the process unit 3, a front drive roller 31 and a back drive roller 32 are provided on both sides of the rotation drum 30, and the sheet S transported in the transport direction Df from the front drive roller 31 to the back drive roller 32 is supported at the rotation drum 30 and is subjected to image recording.

The front drive roller 31 includes a plurality of minute projections which are formed by thermal spraying on the outer circumferential surface thereof, and the sheet S delivered by the delivery unit 2 is wound around the front drive roller 31 from the back surface side. By rotating the front drive roller 31 in the clockwise direction in FIG. 1, the sheet S delivered by the delivery unit 2 is transported to a downstream side in the transport direction Df. In addition, the front drive roller 31 is provided with a nipping roller 31*n* (driven roller). The nipping roller 31*n* abuts on the surface of the sheet S in a state of being biased to the side of the front drive roller 31 and pinches the sheet S with the front drive roller 31. In so doing, it is possible to secure frictional force between the front drive roller 31 and the sheet S and thereby to reliably transport the sheet S by the front drive roller 31.

The rotation drum 30 is a cylindrical drum which is supported so as to be rotatable in both the transport direction Df and the opposite direction Db by a support mechanism which is not shown in the drawing. The rotation drum 30 is configured of metal (aluminum) and has a diameter of 690 mm. A radius of the rotation drum 30 changes by 0.00818 mm if a temperature changes by 1° C. The sheet S transported from the front drive roller 31 to the back drive roller 32 is wound around the rotation drum 30 from the back surface side, the rotation drum 30 is rotated along with the sheet S due to the frictional force between the rotation drum 30 and the sheet A and supports the sheet S from the back surface side. In addition, the process unit 3 is provided with driven rollers 33 and 34 configured to fold back the sheet S on both sides of the rotation drum 30, on which the sheet S is folded back to be wound around the rotation drum 30. The driven roller 33 folds back the sheet S by winding the surface of the sheet S between the front drive roller 31 and the rotation drum 30. In contrast, the driven roller 34 folds back the sheet S by winding the surface of the sheet S between the rotation drum 30 and the back drive roller 32. By folding back the sheet S on both the upstream side and the downstream side of the rotation drum 30 in the transport direction Df as described above, it is possible to secure a long length for a portion of the rotation drum 30 around which the sheet S is wound.

The back drive roller 32 includes a plurality of minute projections formed by thermal spraying on the outer circumferential surface thereof, and the sheet S transported from the rotation drum 30 via the driven roller 34 is wound around the back drive roller 32 from the back surface side. By rotating the back drive roller 32 in the clockwise direction in FIG. 1, the sheet S is transported to the winding unit 4 on the downstream side in the transport direction Df. In addition, the back drive roller 32 is provided with a nipping roller 32*n* (driven roller). The nipping roller 32*n* abuts on the surface of the sheet S in a state of being biased to the side of the back drive roller 32 and pinches the sheet S with the back drive roller 32. In doing so, it is possible to secure frictional force between the back drive roller 32 and the sheet S and to reliably transport the sheet S by the back drive roller 32.

As described above, the sheet S transported from the front drive roller 31 to the back drive roller 32 is supported at the outer circumferential surface of the rotation drum 30. In addition, the process unit 3 is provided with a plurality of recording heads 51 corresponding to different colors in order to record a color image on the surface of the sheet S supported at the rotation drum 30. Specifically, four recording heads 51 corresponding to yellow, cyan, magenta, and black are aligned in this order in the transport direction Df. Each recording head 51 faces the surface of the sheet S, which is wound around the rotation drum 30, with a small clearance and ejects ink (color ink) of a corresponding color from nozzles. By causing the respective recording heads 51 to eject the ink onto the sheet S which is transported in the transport direction Df, the color image is formed on the surface of the sheet S.

As the ink, ultraviolet (UV) ink (photocurable ink) which is cured by irradiation with ultraviolet light (light) is used.

Thus, the process unit 3 is provided with UV irradiators 61 and 62 (irradiation units) in order to cure and fix the ink on the sheet S. The curing of the ink is executed in two stages, namely temporary curing and final curing. Between the plurality of recording heads 51, a UV irradiator 61 for temporary curing is arranged. That is, the ink is cured (temporarily cured) to some extent, to which an ink spreading speed becomes sufficiently low as compared with a case in which the ink is not irradiated with ultraviolet light, by the UV irradiator 61 irradiating the ink with the ultraviolet light of low irradiation intensity, and the ink is not completely cured. In contrast, the UV irradiator 62 for final curing is provided on the downstream side of the plurality of recording heads 51 in the transport direction Df. That is, the UV irradiator 62 is for curing (finally curing) the ink to an extent, to which spreading of the ink is stopped, by irradiating the ink with the ultraviolet light of higher irradiation intensity than that of the UV irradiator 61.

As described above, the UV irradiator 61 arranged between the plurality of recording heads 51 temporarily cure the color ink which is ejected from the recording heads 51 on the upstream side in the transport direction Df onto the sheet S. Therefore, the ink ejected by a certain recording head 51 is temporarily cured until the ink reaches another recording head 51 that is adjacent to the certain recording head 51 on the downstream side in the transport direction Df. In so doing, mixing of different color ink is suppressed. The plurality of recording heads 51 eject different color ink and form a color image on the sheet S in the state in which the mixing of colors is suppressed. Furthermore, the UV irradiator 62 for final curing is provided on the downstream side of the plurality of recording heads 51 in the transport direction Df. For this reason, the color image formed by the plurality of recording heads 51 is finally cured and fixed on the sheet S by the UV irradiator 62.

Furthermore, a recording head 52 is provided on the downstream side of the UV irradiator 62 in the transport direction Df. The recording head 52 faces the surface of the sheet, which is wound around the rotation drum 30, with a small clearance and ejects transparent UV ink from nozzles by an ink jet scheme. That is, the transparent ink is further ejected onto the color image which is formed by the recording heads 51 for the four colors. The transparent ink is ejected to the entire surface of the color image and provides a glossy appearance or a matt appearance to the color image. In addition, the UV irradiator 63 (irradiation unit) is provided on the downstream side of the recording head 52 in the transport direction Df. By the UV irradiator 63 irradiating the transparent ink with intense ultraviolet light, the transparent ink ejected by the recording head 52 is finally cured. In so doing, the transparent ink can be fixed to the surface of the sheet S.

As described above, the process unit 3 appropriately ejects the ink onto the sheet S, which is wound around the outer circumferential portion of the rotation drum 30, cures the ink, and form the color image coated with the transparent ink. Then, the sheet S with the color image formed thereon is transported to the winding unit 4 by the back drive roller 32.

The winding unit 4 includes a driven roller 41 around which the sheet S is wound form the back surface side between the winding shaft 40 and the back drive roller 32, in addition to the winding shaft 40 around which the end of the sheet S is wound. The winding shaft 40 winds and supports the end of the sheet S in a state in which the front surface of the sheet S faces the outside. That is, if the winding shaft 40 is rotated in the rotation direction Cf (clockwise direction in FIG. 1), the sheet S transported by the back drive roller 32 is then wound around the winding shaft 40 via the driven roller 41. In addition, the sheet S is wound around the winding shaft 40 via a core tube 42 which can be attached to and detached from the winding shaft 40. Therefore, if the winding shaft 40 becomes full with the sheet S wound around the winding shaft 40, it is possible to detach the sheet S along with the core tube 42.

In addition, the printer 1 according to the embodiment is provided with foreign matter sensors 71 and 72 configured to detect presence of a foreign matter on the sheet S and a foreign matter sensor 73 configured to detect presence of a foreign matter on the rotation drum 30. Here, the foreign matter on the sheet S includes at least one of a wrinkle, a folded part, a torn part, a frayed part, and a fluffing part of the sheet S, ink which does not configure an image and adheres to and is solidified on the sheet S, an adhesive which adheres to the sheet S and configures a part of the sheet S, and dust which adheres to the sheet S. The foreign matter on the rotation drum 30 includes at least one of ink which adheres to and is solidified on the outer circumferential surface of the rotation drum 30 and does not configure an image, an adhesive which configures a part of the sheet S, and dust.

The foreign matter sensor 71 is arranged between the driven roller 33 and the rotation drum 30 and detects the state of the surface of the sheet S on the upstream side of the recording heads 51 and 52 in the transport direction Df. That is, the foreign matter sensor 71 detects presence of a foreign matter on the sheet S before an image is recorded by the recording heads 51 and 52, on the front surface side of the sheet S. In addition, a detection region of the foreign matter sensor 71 is backed up by a backup roller 35 around which the sheet S is wound from the back surface side, and flapping of the sheet S in the detection region of the foreign matter sensor 71 is suppressed.

The foreign matter sensor 72 detects the state of the back surface of the sheet S on the downstream side of the recording heads 51 and 52 in the transport direction Df. That is, the foreign matter sensor 72 detects presence of a foreign matter on the sheet S after the image is recorded by the recording heads 51 and 52, on the back surface side of the sheet S. Here, the foreign matter sensor 72 performs the detection on the back surface side instead of the front surface side of the sheet S mainly for the following reasons. That is, a wrinkle, a folded part, or a tone part of the sheet S can be detected on the back surface side of the sheet S. Furthermore, there is an advantage in that it is possible to exclude an influence of the image recorded on the surface of the sheet S on detection accuracy of the foreign matter sensor 72 by detecting the presence of the foreign matter on the back surface side of the sheet S. Moreover, the detection region of the foreign matter sensor 72 is backed up by the driven roller 34 around which the sheet S is wound from the front surface side, and flapping of the sheet S in the detection region of the foreign matter sensor 72 can be suppressed.

The foreign matter sensor 73 detects a state of a portion (exposed portion E) of the outer circumferential surface of the rotation drum 30, around which the sheet S is not wound, and which is exposed. That is, the foreign matter sensor 73 detects presence of the foreign matter on the outer circumferential surface of the rotation drum 30 at the exposed portion E. In addition, a temperature sensor 77 configured to measure a temperature of the outer circumferential surface of the rotation drum 30 is provided at the exposed portion E, and the position of the foreign matter sensor 73 is adjusted in accordance with the temperature measured by the temperature sensor 77, as will be described later. As such a temperature sensor 77, any of a contact-type temperature sensor and a non-contact-type temperature sensor can be employed.

Figure 2:
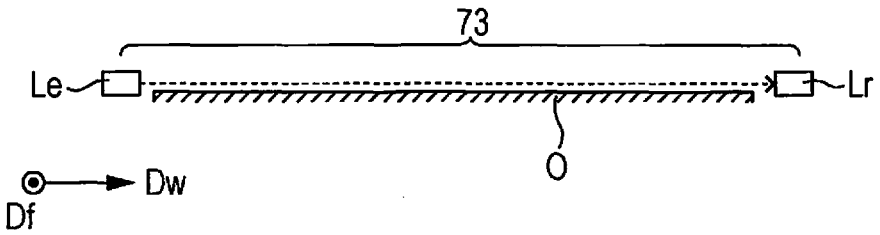
FIG. 2 is a diagram schematically showing a configuration of a foreign matter sensor.

FIG. 2 is a diagram schematically showing an example of a configuration of each foreign matter sensor. Since the foreign matter sensors 71, 72, and 73 have the same configuration, only the foreign matter sensor 73 will be described herein. The foreign matter sensor 73 includes a light emitting unit Le configured to emit light and a light receiving unit r configured to receive light. In a width direction which orthogonally intersects the transport direction Df and is parallel with a surface of an object O (the outer circumferential surface of the rotation drum 30 herein), the light emitting unit Le is arranged on one side of the object O, the light receiving unit Lr is arranged on the other side of the object O, and the light emitting unit Le and the light receiving unit Lr face each other in the width direction Dw. Therefore, if there is no foreign matter on the object O between the light emitting unit Le and the light receiving unit Lr, the light emitted by the light emitting unit Le advances along the object O and reaches the light receiving unit Lr, and the light receiving unit Lr outputs a signal of a first level. In contrast, if there is a foreign matter on the object O between the light emitting unit Le and the light receiving unit Lr, at least a part of the light emitted by the light emitting unit Le is blocked by the foreign matter and does not reach the light receiving unit Lr, and the light receiving unit Lr outputs a signal of a second level that is lower than the first level. As described above, the foreign matter sensor 73 outputs signals of different levels from the light receiving unit Lr depending on presence of a foreign matter on the object O.

Figure 3:
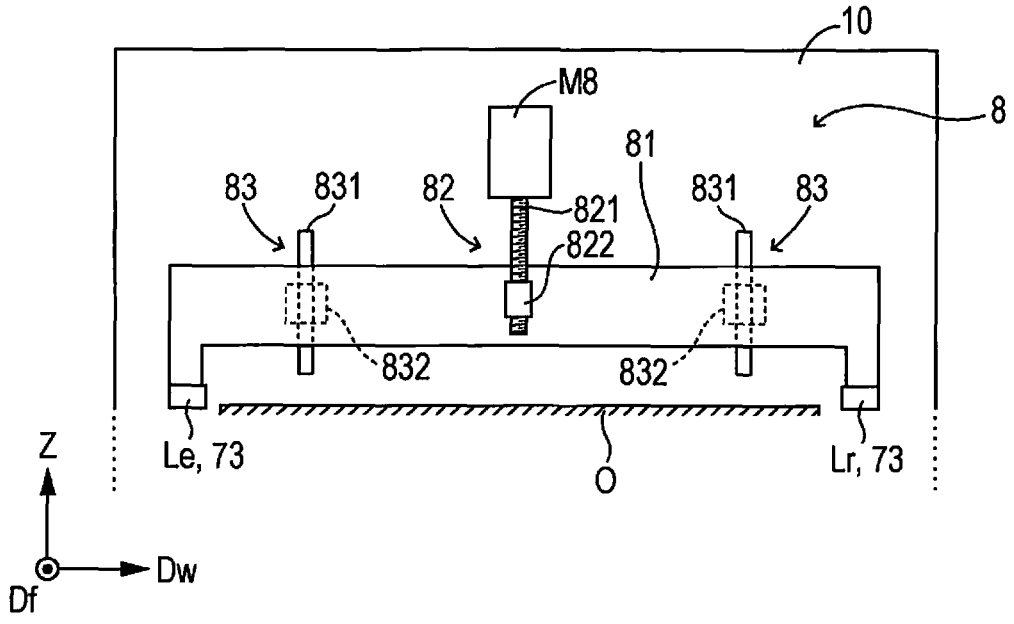
FIG. 3 is a diagram showing a configuration of a drive unit which moves the foreign matter sensor.

The foreign matter sensor 73 from among the foreign matter sensors 71, 72, and 73 can move relative to the object O. Specifically, the printer 1 is provided with a drive unit 8 configured to move the foreign matter sensor 73 (FIG. 3). Here, FIG. 3 is a diagram schematically showing an example of a configuration of the drive unit for moving the foreign matter sensor. As shown in FIG. 3, the drive unit 8 includes a coupling member 81, a ball screw 82, a linear motion (LM) guide 83, and a sensor motor M8.

The coupling member 81 has a shape extending in the width direction Dw, and the light emitting unit Le and the light receiving unit Lr are fixed to both ends of the coupling member 81 in the width direction Dw. In addition, the coupling member 81 is attached to a frame 10 of the printer 1 via the LM guide 83. The LM guide 83 is configured of an LM rail 831 extending in a Z direction (a direction orthogonally intersecting the transport direction Df and the width direction Dw) of approaching and separating from the object O and an LM block 832 which moves along the LM rail 831. The LM rail 831 is attached to the frame 10, and the LM block 832 is attached to the coupling member 81. As described above, the coupling member 81 can move in the Z direction along with the foreign matter sensor 73 (the light emitting unit Le and the light receiving unit Lr).

Such a coupling member 81 is connected to the sensor motor M8, which is fixed to the frame 10, via the ball screw 82. The ball screw 82 is configured of a screw shaft 821 extending in the Z direction and a nut 822 fitted onto the screw shaft 821. The screw shaft 821 is attached to an output shaft of the sensor motor M8, and the nut 822 is attached to the coupling member 81. Therefore, by the sensor motor M8 rotating the screw shaft 821, it is possible to move the coupling member 81 in the Z direction and to move the foreign matter sensor 73 (the light emitting unit Le and the light receiving unit Lr) in the Z direction.

Figure 4:
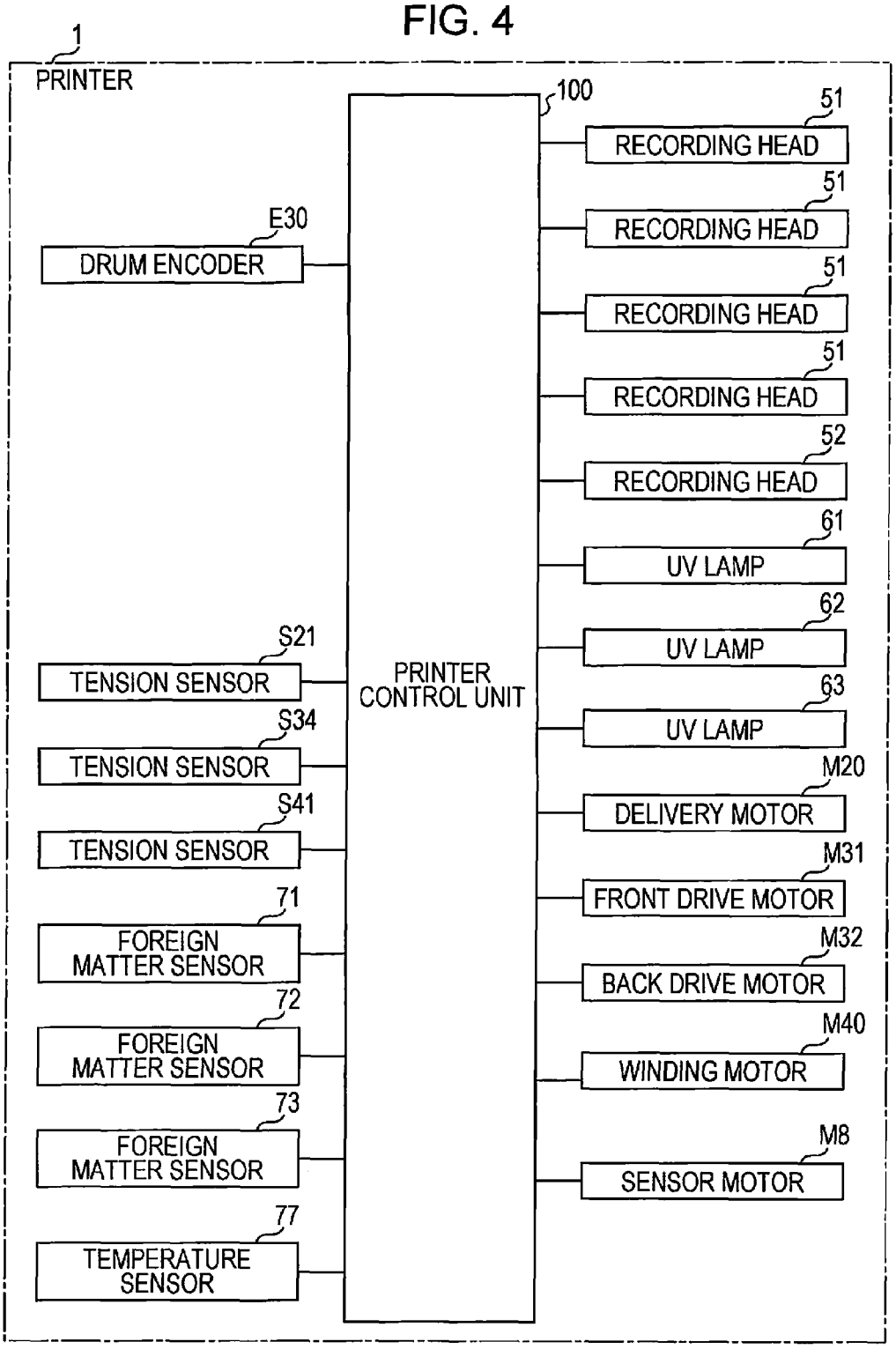
FIG. 4 is a block diagram showing an electric configuration which controls the printer shown in FIG. 1.

The outline of the apparatus configuration of the printer 1 was described hitherto. Next, a description will be given of an electrical configuration for controlling the printer 1. FIG. 4 is a block diagram schematically showing an example of an electrical configuration for controlling the printer shown in FIG. 1. The printer 1 is provided with a printer control unit 100 configured to control the respective components in the printer 1. In addition, the printer control unit 100 controls the respective components of the apparatus, such as the recording heads, the UV irradiators, and the sheet transport system. Details of the control performed by the printer control unit 100 on the respective components in the apparatus are as follows.

The printer control unit 100 controls an ink ejection timing of each recording head 51 for forming a color image in accordance with transport of the sheet S. Specifically, the ink ejection timing is controlled based on an output (detection value) of a drum encoder E30 which is attached to the rotation shaft of the rotation drum 30 and detects a rotation position of the rotation drum 30. That is, since the rotation drum 30 is rotated along with the transport of the sheet S, it is possible to grasp the transport position of the sheet S with reference to the output of the drum encoder E30 which detects the rotation position of the rotation drum 30. Thus, the printer control unit 100 forms a color image by generating a print timing signal (pts) based on the output of the drum encoder E30, controlling the ink ejection timing of each recording head 51 based on the pts signal, and causing the ink ejected by each recording head 51 to land on a targeted position on the transported sheet S.

In addition, a timing at which the recording head 52 ejects the transparent ink is also controlled by the printer control unit 100 based on the output of the drum encoder E30 in the same manner. In so doing, it is possible to precisely eject the transparent ink onto the color image which is formed by the plurality of recording heads 51. Furthermore, a timing at which the UV irradiators 61, 62, and 63 are turned on or off and irradiation light intensities thereof are also controlled by the printer control unit 100.

In addition, the printer control unit 100 has a function of controlling the transport of the sheet S, which was described above in detail with reference to FIG. 1. That is, motors are connected to the delivery shaft 20, the front drive roller 31, the back drive roller 32, and the winding shaft 40 from among the members which configure the sheet transport system. In addition, the printer control unit 100 controls the transport of the sheet S by controlling speeds and torques of the respective motors while rotating these motors. A detailed description of the control of the transport of the sheet S will be given below.

The printer control unit 100 rotates a delivery motor M20 for driving the delivery shaft 20 and supplies the sheet S from the delivery shaft 20 to the front drive roller 31. At this time, the printer control unit 100 adjusts tension (delivery tension Ta) of the sheet S from the delivery shaft 20 to the front drive roller 31 by controlling a torque of the delivery motor M20. That is, a tension sensor S21 for detecting a magnitude of the delivery tension Ta is attached to the driven roller 21 arranged between the delivery shaft 20 and the front drive roller 31. The tension sensor S21 can be configured of a load cell which detects a magnitude of force applied from the sheet S, for example. Then, the printer control unit 100 feed-back controls the torque of the delivery motor M20 based on the detection result (detection value) of the tension sensor S21 and adjusts the delivery tension Ta of the sheet S.

In addition, the printer control unit 100 rotates a front drive motor M31 for driving the front drive roller 31 and a back drive motor M32 for driving the back drive roller 32. In so doing, the sheet S delivered by the delivery unit 2 is made to pass through the process unit 3. At this time, a speed of the front drive motor M31 is controlled, and a torque of the back drive motor M32 is controlled. That is, the printer control unit 100 adjusts the rotation speed of the front drive motor M31 to a constant speed based on the output of the encoder of the front drive motor M31. As described above, the sheet S is transported at a constant speed by the front drive roller 31.

In contrast, the printer control unit 100 adjusts tension (process tension Tb) of the sheet S from the front drive roller 31 to the back drive roller 32 by controlling a torque of the back drive motor M32. That is, a tension sensor S34 for detecting a magnitude of the process tension Tb is attached to the driven roller 34 arranged between the rotation drum 30 and the back drive roller 32. The tension sensor S34 can be configured of a load cell which detects a magnitude of force applied form the sheet S, for example. Then, the printer control unit 100 feed-back controls the torque of the back drive motor M32 based on the detection result (detection value) of the tension sensor S34 and adjusts the process tension Tb of the sheet S.

In addition, the printer control unit 100 winds the sheet S, which is transported by the back drive roller 32, around the winding shaft 40 by rotating a winding motor M40 for driving the winding shaft 40. At this time, the printer control unit 100 adjusts tension (winding tension Tc) of the sheet S from the back drive roller 32 to the winding shaft 40 by controlling a torque of the winding motor M40. That is, a tension sensor S41 for detecting a magnitude of the winding tension Tc is attached to the driven roller 41 arranged between the back drive roller 32 and the winding shaft 40. The tension sensor S41 can be configured of a load cell which detects a magnitude of force applied from the sheet S, for example. Then, the printer control unit 100 feed-back controls the torque of the winding motor M40 based on the detection result (detection value) of the tension sensor S41 and adjusts the winding tension Tc of the sheet S.

As described above, the printer control unit 100 causes the recording heads 51 and 52 to record an image on the sheet S while transporting the sheet S in the transport direction Df from the delivery shaft 20 toward the winding shaft 40. In addition, the printer control unit 100 can also execute backward transport of transporting the sheet S in the transport direction Db (that is, the direction opposite to the transport direction Df) from the winding shaft 40 toward the delivery shaft 20 as well as forward transport of transporting the sheet S in the transport direction Df. Specifically, the printer control unit 100 executes the backward transport by controlling the respective motors M20, M31, M32, and M40 so as to rotate the delivery shaft 20, the front drive roller 31, the back drive roller 32, and the winding shaft 40 in the direction opposite to the direction in the case of the forward transport. Such backward transport can be executed for various purposes as proposed in JP-A-2013-129062. For example, the backward transport is executed to form a new image so as to be adjacent to an image, which has already been formed on the sheet S, by appropriately returning the sheet S to the side of the delivery shaft 20 when suspended image recording is restarted again.

During execution of the forward transport, the printer control unit 100 monitors detection results of the foreign matter sensors 71 and 73. If the foreign matter sensors 71 and 73 detect a foreign matter, the printer control unit 100 stops the forward transport. That is, if the foreign matter sensor 71 detects a foreign matter on the sheet S, there is a concern in that the foreign matter collides with the recording heads 51 and 52 if the foreign matter is transported in the transport direction Df without being removed. If the foreign matter sensor 73 detects a foreign matter on the rotation drum 30, the foreign matter enters between the sheet S and the rotation drum 30 and lifts the sheet S if the foreign matter is transported in the transport direction Df without being removed. As a result, there is a concern in that the lifted portion of the sheet S collides with the recording heads 51 and 52. Thus, the printer control unit 100 stops the forward transport in order to avoid the collision with the recording heads 51 and 52.

In contrast, the printer control unit 100 monitors detection results of the foreign matter sensors 72 and 73 during execution of the backward transport. If the foreign matter sensors 72 and 73 detect a foreign matter, the printer control unit 100 stops the backward transport. That is, if the foreign matter sensor 72 detects a foreign matter on the sheet S, there is a concern in that the foreign matter collides with the recording heads 51 and 52 if the foreign matter is transported in the transport direction Db without being removed. If the foreign matter sensor 73 detects a foreign matter on the rotation drum 30, the foreign matter enters between the sheet S and the rotation drum 30 and lifts the sheet S if the foreign matter is transported in the transport direction Db without being removed. As a result, there is a concern in that the lifted portion of the sheet S collides with the recording heads 51 and 52. Thus, the printer control unit 100 stops the backward transport in order to avoid the collision with the recording heads 51 and 52.

Incidentally, according to the printer 1 as described above, a temperature in the apparatus can vary with time. For example, the temperature in the apparatus increases during continuous image recording while the temperature gradually decreases after the image recording is completed. As a result, there is a case in which the rotation drum 30 thermally expands or thermally contracts and a position of the outer circumferential surface of the rotation drum 30 is displaced in the diameter direction (Z direction). In such a case, there is a concern in that the relative positional relationship between the foreign matter sensor 73 and the outer circumferential surface of the rotation drum 30 as the object O varies and the detection accuracy of the foreign matter sensor 73 deteriorates. In a specific example, a foreign matter is not completely within the optical path of the light emitted from the light emitting unit Le to the light receiving unit Lr and the foreign matter cannot be detected correctly if the foreign matter sensor 73 is located at an excessively far position from the object O. In addition, a major part of the light emitted from the light emitting unit Le is scattered by the surface of the object O and the foreign matter cannot be detected correctly if the foreign matter sensor 73 is located at an excessively close position to the object O. According to the configuration in which an image is fixed on the sheet S by curing the UV ink as in the embodiment, in particular, the rotation drum 30 is heated by curing reaction heat of the UV ink, the position of the outer circumferential surface is displaced in the diameter direction (Z direction), and therefore, the detection accuracy of the foreign matter sensor 73 easily deteriorates. Thus, the printer control unit 100 executes the following control.

That is, the printer control unit 100 is triggered by power supply to the printer 1, start of image recording, or the like, causes the temperature sensor 77 to measure the temperature, and acquires the temperature measured by the temperature sensor 77 at a predetermined time interval (one second, for example). Then, the printer control unit 100 moves the foreign matter sensor 73 in the Z direction by controlling a sensor motor M8 in accordance with the acquired result. Specifically, the printer control unit 100 calculates a correction value based on the following equation:

$$\text{Correction value} = \text{rate of change in drum radius} \times \text{amount of change in drum temperature}$$

Here, the rate of change in the drum radius is an amount by which the radius of the rotation drum 30 changes during a change in temperature by 1° C. and is assumed to be 0.00818 mm/° C. herein. In addition, the amount of change in the drum temperature is a value obtained by subtracting an initial temperature from the temperature measured by the temperature sensor 77. In addition, the initial temperature is a temperature when calibration is performed for the position of the foreign matter sensor 73 relative to the rotation drum 30 before shipping from a factory and is stored on the printer control unit 100. As such an initial temperature, an average value of results obtained by measuring the temperature of the outer circumferential surface of the rotation drum 30 by the temperature sensor 77 while rotating the rotation drum 30 once, for example. Furthermore, the printer control unit 100 stores a position of the foreign matter sensor 73 in the Z direction at the time of the calibration (at the initial temperature) as an initial position.

Then, the printer control unit 100 positions the foreign matter sensor 73 at the adjusted position obtained by adding the correction value to the initial position in the Z direction. In relation to the Z direction, a side away from the rotation drum 30 is assumed to be a positive side. When the temperature measured by the temperature sensor 77 is higher than the initial temperature, the foreign matter sensor 73 is positioned at an adjusted position which is further away from the rotation drum 30 than the initial position. When the temperature measured by the temperature sensor 77 is lower than the initial temperature, the foreign matter sensor 73 is positioned at an adjusted position which is closer to the rotation drum 30 than the initial position. At this time, it is possible to suppress an influence of vibration caused by the motion of the foreign matter sensor 73 on the recording heads 51 and 52 and the like by moving the foreign matter sensor 73 at a moving speed of equal to or less than 10 μm/second.

According to the embodiment, there is a concern in that the relative positional relationship between the foreign matter sensor 73 and the rotation drum 30 changes due to the thermal expansion of the rotation drum 30 with an increase in temperature and the accuracy of detecting a foreign matter on the rotation drum 30 by the foreign matter sensor 73 deteriorates as described above. Thus, since the foreign matter sensor 73 can be moved by the drive unit 8, it is possible to adjust the relative positional relationship between the foreign matter sensor 73 and the rotation drum 30. As a result, it is possible to handle the deterioration of the detection accuracy of the foreign matter sensor 73 caused by the variations in the relative positional relationship between the foreign matter sensor 73 and the rotation drum 30.

In particular, the printer control unit 100 adjusts the relative positional relationship between the foreign matter sensor 73 and the rotation drum 30 by controlling the drive unit 8 in accordance with the temperature of the rotation drum 30, which is acquired by the temperature sensor 77. With such a configuration, it is possible to adjust the relative positional relationship between the foreign matter sensor 73 and the rotation drum 30 in accordance with the thermal expansion of the rotation drum 30. As a result, it is possible to suppress the deterioration of the detection accuracy of the foreign matter sensor 73 caused by the variations in the relative positional relationship between the foreign matter sensor 73 and the rotation drum 30.

According to the embodiment, the printer 1 corresponds to an example of the "image recording apparatus" of the invention, the foreign matter sensor 73 corresponds to an example of the "sensor" of the invention, the rotation drum 30 corresponds to an example of the "object" of the invention, the drive unit 8 corresponds to an example of the "drive unit" of the invention, the printer control unit 100 corresponds to an example of the "control unit" of the invention, the rotation drum 30 corresponds to an example of the "support member" of the invention, the temperature sensor 77 corresponds to an example of the "acquisition unit" of the invention, and the temperature measured by the temperature sensor 77 corresponds to an example of the "information relating to the thermal expansion of the support member" of the invention.

The invention is not limited to the above embodiment, and various modifications cam be added to the aforementioned configurations without departing from the gist thereof. According to the embodiment, the correction value for the position of the foreign matter sensor 73 is acquired by calculation. However, a relationship between the correction value and an amount of variations in drum temperature may be stored in the form of a table, and the correction value may be acquired based on the table.

In addition, the temperature of the rotation drum 30 which is measured by the temperature sensor 77 is acquired as the "information relating to the thermal expansion of the rotation drum 30". However, since the temperature of the sheet S and the temperature of the rotation drum 30 have a correlation, a temperature sensor configured to measure the temperature of the sheet S may be provided to acquire the temperature measured by the temperature sensor as the "information relating to the thermal expansion of the rotation drum 30". Alternatively, a distance sensor configured to measure a position of the outer circumferential surface of the rotation drum 30 may be provided to acquire a result of measuring displacement of the outer circumferential surface of the rotation drum 30 due to the thermal expansion by the distance sensor as the "information relating to the thermal expansion of the rotation drum 30".

Alternatively, it is also possible to acquire a print duty from print data indicating an image to be recorded on the sheet S and to perform the same control based on the print duty. That is, a temperature rising pattern of the rotation drum 30 has a correlation with the amount of ink which causes a curing reaction on the sheet S, and the amount of ink can be roughly calculated from the print duty. Therefore, if a relationship between the print duty and the change in temperature per unit time when image recording is performed at the print duty is stored in the form of a table, the temperature of the rotation drum 30 can be estimated based on the print duty and print time. That is, it is possible to acquire the print duty as the "information relating to the thermal expansion of the rotation drum 30". In addition, it is not necessary that the print duty is a precise value at the respective timing, and an average value over time, for example, may be used.

Incidentally, there is a concern in that decrease in detection accuracy caused by variations in a relative positions with respect to the object O also occurs in the foreign matter sensors 71 and 72. Specifically, if the type of the sheet S is changed and the thickness of the sheet S is changed, there is a concern in that a relative positional relationship between the surface of the sheet S and the foreign matter sensors 71 and 72 changes and the detection accuracy of the foreign matter sensors 71 and 72 deteriorates. Thus, the foreign matter sensors 71 and 72 may be provided with the drive unit 8 as shown in FIG. 3. With such a configuration, it is possible to move the foreign matter sensors 71 and 72 by the drive unit 8, and therefore, it is possible to adjust the relative positional relationship between the foreign matter sensors 71 and 72 and the sheet S. As a result, it is possible to handle the deterioration of the detection accuracy of the foreign matter sensors 71 and 72.

Figure 5:
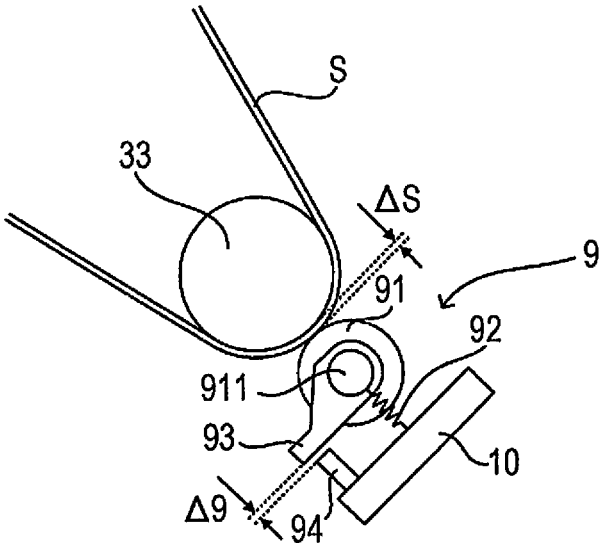
FIG. 5 is a diagram schematically showing a configuration of a thickness sensor.

At this time, the positions of the foreign matter sensors 71 and 72 in the Z direction may be adjusted based on a result of detecting the thickness of the sheet S by a thickness sensor as shown in FIG. 5. Here, FIG. 5 is a diagram schematically showing an example of a configuration of the thickness sensor. The thickness sensor 9 (acquisition unit) includes a driven roller 91 capable of rotating about a rotation shaft 911, a compression spring 92 (biasing member) inserted between the driven roller 91 and the frame 10, a metal plate 93 fixed to the rotation shaft 911 of the driven roller 91, and a distance sensor 94 fixed to the frame 10 in a state of facing the metal plate 93. The driven roller 91 pinches the sheet S with the driven roller 33 in a state of being biased to the side of the driven roller 33 by the compression spring 92. Then, if a thickness ΔS of the sheet S varies, the position of the driven roller 91 is displaced, and a distance Δ9 between the metal plate 93 and the distance sensor 94 varies. Therefore, it is possible to know the thickness of the sheet S based on the distance to the metal plate 93, which is measured by the distance sensor 94.

Thus, the printer control unit 100 adjusts the positions of the foreign matter sensors 71 and 72 in the Z direction based on the measurement result of the distance sensor 94 which configures the thickness sensor 9. Specifically, the foreign matter sensors 71 and 72 are moved in the Z direction by the amount of change in the thickness of the sheet S which is represented by the measurement result of the distance sensor 94. If the thickness of the sheet S increases at this time, the foreign matter sensors 71 and 72 are moved so as to be away from the sheet S. If the thickness of the sheet S decreases, the foreign matter sensors 71 and 72 are made to approach the sheet S.

With such a configuration, it is possible to adjust the relative positional relationship between the foreign matter sensors 71 and 72 and the sheet S in accordance with the thickness of the sheet S. As a result, it is possible to suppress the deterioration of the detection accuracy of the foreign matter sensors 71 and 72 caused by the variations in the relative positional relationship between the foreign matter sensors 71 and 72 and the sheet S.

In the example shown in FIG. 5, the information relating to the thickness of the sheet S is acquired by the thickness sensor 9. However, a method of acquiring such information is not limited to the thickness sensor 9. Thus, another configuration is also applicable in which a user interface is provided and information relating to the thickness of the sheet S that a user inputs through the user interface is acquired. Alternatively, a configuration is also applicable in which a sensor configured to determine a type of the sheet S is provided in a transport path and a thickness of the sheet S corresponding to the type thereof is stored in advance and is then acquired in accordance with the type of the sheet S detected by the sensor.

If the relative positional relationship between the foreign matter sensors 71, 72, and 73 and the object O varies, the positional relationship between the recording heads 51 and 52 and the sheet S varies in the same manner. Therefore, a case in a clearance between the recording heads 51 and 52 and the sheet S becomes inappropriate can also be assumed. Thus, the recording heads 51 and 52 may be moved along with the foreign matter sensors 71, 72, and 73 when the foreign matter sensors 71, 72, and 73 are moved.

In the aforementioned embodiment, the description was given of the case in which the invention was applied to the foreign matter sensors 71, 72, and 73. However, the type of the sensor to which the invention can be applied is not limited to a foreign matter sensor, and the invention can be generally applied to sensors capable of detecting a state of the object O.

In the aforementioned embodiment, an image is recorded by causing the recording heads 51 and 52 to eject the UV ink. However, an image may be recorded by causing the recording heads 51 and 52 to eject water-based ink.

In the aforementioned embodiment, the foreign matter sensor 72 is arranged on the back surface side of the sheet S and detects presence of a foreign matter on the sheet S on the back surface side of the sheet S. However, another configuration is also applicable in which the foreign matter sensor 72 is arranged on the front surface side of the sheet S and detects presence of a foreign matter on the sheet S on the front surface side of the sheet S.

In addition, a member which supports the transported sheet S is not limited to the member with a cylindrical shape such as the aforementioned rotation drum 30. Therefore, it is also possible to employ a flat-type platen which supports the sheet S by a plane.

The entire disclosure of Japanese Patent Application No. 2014-054353, filed Mar. 18, 2014 is expressly incorporated by reference herein.

What is claimed is:

1. An image recording apparatus comprising:

a recording head configured to record an image on a recording medium;

a sensor configured to detect a state of an object including a surface of the recording medium or a surface of a support member that supports the recording medium;

an acquisition unit configured to acquire information corresponding to a temperature change of the support member;

a drive unit configured to move the sensor in a first direction that is perpendicular to the surface of the recording medium or the surface of the support member; and a control unit configured to calculate a change amount of a relative positional relationship between the sensor and the object in the first direction by using a predetermined relation between the change amount of the relative positional relationship and the temperature change of the support member based on the information acquired by the acquisition unit, and configured to control the drive unit to move the sensor in the first direction by the change amount of the relative positional relationship.

2. The image recording apparatus according to claim 1, wherein the object is able to support a recording medium, on which an image is recorded, and is a support member which thermally expands with an increase in temperature.

3. The image recording apparatus according to claim 1, wherein the object is a recording medium on which an image is recorded.

4. The image recording apparatus according to claim 3, wherein the acquisition unit acquires information relating to a thickness of the recording medium, and the control unit controls the drive unit in accordance with the information acquired by the acquisition unit and adjusts a relative positional relationship between the sensor and the recording medium.

5. The image recording apparatus according to claim 1, wherein the control unit further controls the drive unit to move the recording head in the first direction along with the sensor.

6. The image recording apparatus according to claim 1, wherein the acquisition unit acquires a print duty as the information.

7. An image recording apparatus comprising:

a surface state sensor configured to detect a surface state of a support member that supports a recording medium on which an image is recorded, the support member thermally expanding with an increase in temperature;

a drive unit configured to move the surface state sensor in a first direction that is perpendicular to a surface of the support member;

a control unit configured to control the drive unit; and a temperature sensor configured to sense a temperature of the support member or the recording medium, wherein the control unit calculates a change amount of a relative positional relationship between the surface state sensor and the object in the first direction by using a predetermined relation between the change amount of the relative positional relationship and a temperature change of the support member or the recording medium based on the temperature sensed by the temperature sensor, and the control unit controls the drive unit to move the surface state sensor in the first direction by the change amount of the relative positional relationship.

8. The image recording apparatus according to claim 7, wherein the acquisition unit acquires, as the information, at least one of a temperature of the support member, a temperature of the recording medium, and displacement of the support member caused by the thermal expansion.

9. An image recording method comprising:

recording an image on a recording medium;

detecting a state of an object including a surface of the recording medium or a surface of a support member that supports the recording medium by a sensor;

acquiring information corresponding to a temperature change of the support member;

calculating a change amount of a relative positional relationship between the sensor and the object in a first direction by using a predetermined relation between the change amount of the relative positional relationship and the temperature change of the support member based on the information, with the first direction being perpendicular to the surface of the recording medium or the surface of the support member; and controlling a drive unit to move the sensor in the first direction by the change amount of the relative positional relationship.

* * * * *